US012043942B2

(12) United States Patent
Snook et al.

(10) Patent No.: US 12,043,942 B2
(45) Date of Patent: Jul. 23, 2024

(54) DISPENSER FOR A LAUNDRY WASHING MACHINE WITH OVERFLOW CONFIGURATION

(71) Applicant: Midea Group Co., Ltd., Foshan (CN)

(72) Inventors: Bryan T. Snook, Louisville, KY (US); Fan Jianfeng, Wuxi (CN)

(73) Assignee: MIDEA GROUP CO., LTD., Guangdong (CN)

( * ) Notice: Subject to any disclaimer, the term of this patent is extended or adjusted under 35 U.S.C. 154(b) by 802 days.

(21) Appl. No.: 16/973,676

(22) PCT Filed: Sep. 30, 2020

(86) PCT No.: PCT/CN2020/119623
§ 371 (c)(1),
(2) Date: Dec. 9, 2020

(87) PCT Pub. No.: WO2021/147376
PCT Pub. Date: Jul. 29, 2021

(65) Prior Publication Data

US 2022/0298708 A1 Sep. 22, 2022

Related U.S. Application Data

(63) Continuation-in-part of application No. 16/752,166, filed on Jan. 24, 2020, now Pat. No. 11,421,368.

(51) Int. Cl.
*D06F 39/08* (2006.01)
*D06F 39/02* (2006.01)

(52) U.S. Cl.
CPC ..... *D06F 39/022* (2013.01); *D06F 39/088* (2013.01)

(58) Field of Classification Search
None
See application file for complete search history.

(56) References Cited

U.S. PATENT DOCUMENTS

| | | | |
|---|---|---|---|
| 5,473,914 | A | 12/1995 | Pyo et al. |
| 6,557,382 | B1 | 5/2003 | Koike et al. |
| 6,826,933 | B2 | 12/2004 | Merkle et al. |
| 7,093,467 | B2 | 8/2006 | Kim et al. |
| 8,459,068 | B2 | 6/2013 | Bolduan et al. |

(Continued)

FOREIGN PATENT DOCUMENTS

| | | | |
|---|---|---|---|
| CH | 459940 | A | 7/1968 |
| CN | 1516764 | A | 7/2004 |

(Continued)

OTHER PUBLICATIONS

Hotpoint. Ebay. Hotpoint WT540 Washing Machine. Retrieved from: https://www.ebay.ie/sch/sis.html?_itemId=151165749980&_nkw=hotpoint+aquarius+WT540+soap+drawer+washing+powder+drawer&_mPrRngCbx=1. Retrieved on Sep. 6, 2019.

(Continued)

*Primary Examiner* — Cristi J Tate-Sims
(74) *Attorney, Agent, or Firm* — Gray Ice Higdon

(57) ABSTRACT

A dispenser for a laundry washing machine. The dispenser includes one or more screens adjacent one or more detergent trays. The one or more screens reduce the splashing of fluid to adjacent detergent trays. The one or more screens, or portions thereof, may include a plurality of though openings in fluid communication between one or more sprayers and one or more detergent trays.

17 Claims, 8 Drawing Sheets

(56) References Cited

U.S. PATENT DOCUMENTS

| | | | | |
|---|---|---|---|---|
| 9,297,106 | B2 | 3/2016 | Doh | |
| 9,816,218 | B2 | 11/2017 | Jo et al. | |
| 2004/0172770 | A1 | 9/2004 | Heo et al. | |
| 2005/0274155 | A1 | 12/2005 | Namkung et al. | |
| 2007/0044517 | A1 | 3/2007 | Yang et al. | |
| 2008/0078211 | A1 | 4/2008 | Byoung et al. | |
| 2012/0090361 | A1 | 4/2012 | Greger et al. | |
| 2016/0047078 | A1* | 2/2016 | Leibman | D06F 39/028 68/17 R |
| 2016/0258106 | A1* | 9/2016 | Kim | D06F 39/022 |
| 2017/0233939 | A1 | 8/2017 | Lee | |
| 2019/0218703 | A1 | 7/2019 | Magnusson | |
| 2021/0230786 | A1 | 7/2021 | Snook et al. | |

FOREIGN PATENT DOCUMENTS

| | | | |
|---|---|---|---|
| CN | 1779045 | A | 5/2006 |
| CN | 101760939 | A | 6/2010 |
| CN | 203462318 | U | 3/2014 |
| CN | 106471178 | A | 3/2017 |
| CN | 107227589 | A | 10/2017 |
| CN | 108396515 | A | 8/2018 |
| CN | 209568275 | U | 11/2019 |
| JP | H11290580 | A | 10/1999 |
| JP | 2012029710 | A | 2/2012 |
| KR | 20070015303 | A | 2/2007 |
| KR | 101114338 | B1 | 2/2012 |
| WO | 8001160 | A1 | 6/1980 |
| WO | WO2011023808 | A1 | 3/2011 |
| WO | WO2017097318 | A1 | 6/2017 |

OTHER PUBLICATIONS

International Search Report and Written Opinion issued in Application No. PCT/CN2020/0119623, dated Dec. 30, 2020.

U.S. Patent and Trademark Office, Office Action issued in U.S. Appl. No. 16/752,166 dated Jan. 6, 2022.

U.S. Patent and Trademark Office, Notice of Allowance issued in U.S. Appl. No. 16/752,166 dated Jul. 8, 2022.

The State Intellectual Property Office of People's Republic of China, Second Office Action issued in Application No. 202080094394.5, 21 pages, dated Aug. 9, 2023.

The State Intellectual Property Office of People's Republic of China, First Office Action issued in Application No. 202080094394.5, 15 pages, dated Feb. 22, 2023.

The State Intellectual Property Office of People's Republic of China, Notification to Grant Patent Right issued in Application No. 202080094394.5, 3 pages, dated Jan. 16, 2024.

* cited by examiner

DISPENSER FOR A LAUNDRY WASHING MACHINE WITH OVERFLOW CONFIGURATION

BACKGROUND

The present embodiments relate to a detergent dispenser integrated into a laundry washing machine.

Typical laundry washing machines have multiple trays/cups that are rinsed out at different times during the wash cycle in order to accomplish their designated task. Examples of such trays include, but are not limited to, bleach, detergent, softener, and pre-wash trays. Typically these trays are adjacent each other or in close proximity. At certain times during the wash cycle, the different cups are sprayed with water, often at high pressure, in order to transfer the contents of the tray into the wash, as well as to rinse out the tray. The fluid or spray directed to a particular tray may inadvertently come in contact with additional trays and/or the substances contained therein. This may lead to problems including, but not limited to, a release of a substance at an undesired time or cycle and/or decrease in the performance or efficiency of the substance. Thus, there is a need to reduce fluid contamination to nearby trays and increase rinsing efficiency.

SUMMARY

In some embodiments of the invention, for example, a laundry washing machine may include a first liquid detergent tray. In various embodiments, the laundry washing machine may include a second liquid detergent tray adjacent the first liquid detergent tray. In some embodiments, the laundry washing machine may include at least one sprayer. Moreover, in various embodiments, the laundry washing machine may include at least one screen disposed between at least one sprayer and the first liquid detergent tray and/or the second liquid detergent tray to receive fluid from at least one sprayer and reduce fluid splashing to the other corresponding detergent tray.

In some embodiments, at least one screen may include a plurality of through openings defined by a hexagonal shaped outer periphery. In various embodiments, at least one screen may be disposed over both of the first liquid detergent tray and the second liquid detergent tray. In addition, in some embodiments, at least one screen may include a pour through opening and a plurality of through openings of at least one screen. In various embodiments, the pour through opening may be positioned adjacent to both a first portion of an outer periphery of the first liquid detergent tray and a second portion of an outer periphery of the second liquid detergent tray, wherein the first portion and the second portion are adjacent to each other. In some embodiments, at least one screen may include an outer periphery with recesses therein spaced away from an outer periphery of at least one of the first liquid detergent tray and the second liquid detergent tray. In various embodiments, fluid may flow from at least one sprayer for a first time period through a first portion of at least one screen into the first liquid detergent tray and fluid may flow from at least one sprayer for a second time period through a second portion of at least one screen into the second liquid detergent tray.

In various embodiments, a liquid detergent dispenser may have a screen for reducing fluid transfer between adjacent liquid detergent trays and include a first liquid detergent tray. In some embodiments, the liquid detergent dispenser may include a second liquid detergent tray adjacent the first liquid detergent tray. In addition, in various embodiments, the liquid detergent dispenser may include at least one sprayer. In some embodiments, the liquid detergent dispenser may include at least one screen disposed between at least one sprayer and the first liquid detergent tray and/or the second liquid detergent tray. Moreover, in various embodiments, the liquid detergent dispenser may include a first fluid from at least one sprayer may pass through a first portion of at least one screen during a first time period into the first liquid detergent tray while minimizing fluid into the adjacent second liquid detergent tray. In some embodiments, a second fluid from at least one sprayer may pass through a second portion of at least one screen during a second time period into the second liquid detergent tray while minimizing fluid into the adjacent first liquid detergent tray.

In addition, in some embodiments, at least one screen may include a plurality of hexagonal shaped through openings therein. In various embodiments, at least one screen may include a pour through opening and a plurality of through openings within the first portion and the second portion of at least one screen. In some embodiments, the pour through opening of at least one screen may be disposed over a deflection structure adjacent both outer peripheries of the first liquid detergent tray and the second liquid detergent tray. Moreover, in various embodiments, at least one screen may include one or more recesses in an outer periphery thereof adjacent to one or more recesses in an outer periphery of at least one of the first liquid detergent tray and the second liquid detergent tray. In some embodiments, the liquid detergent dispenser may include a laundry washing machine. In various embodiments, the first liquid detergent tray and the second liquid detergent tray may be removably received within a solid detergent tray. In addition, in some embodiments, the first liquid detergent tray may include a first siphon and/or the second liquid detergent tray may include a second siphon.

In some embodiments, a method of introducing liquid detergent into a wash tub of a laundry washing machine at different time periods may include spraying a first fluid through a first portion of one or more screens into a first liquid detergent tray. In various embodiments, the method may include spraying a second fluid through a second portion of the one or more screens into a second liquid detergent tray adjacent to the first liquid detergent tray. In some embodiments, the method may include blocking lateral spray of the first fluid into the second liquid detergent tray. Moreover, in various embodiments, the method may include blocking lateral spray of the second fluid into the first liquid detergent tray.

In addition, in some embodiments, the method may include adding liquid detergent through the one or more screens to both the first liquid detergent tray and the second liquid detergent tray together at the same time period. In various embodiments, the method may include deflecting liquid detergent towards each one of the first liquid detergent tray and the second liquid detergent tray. In some embodiments, the method may include removing the first liquid detergent tray, the adjacent second liquid detergent tray, and one or more screens from a laundry washing machine. In various embodiments, wherein blocking lateral spray of the first fluid may include blocking spray of the first fluid that has already passed downwardly through the first portion of one or more screens. In some embodiments, wherein spraying the first fluid may include dispensing a first liquid detergent from the first liquid detergent tray at a first time period. Moreover, in various embodiments, spraying the second fluid may include dispensing a second liquid detergent from the second liquid detergent tray at a second time period. In addition, in some embodiments, the first time period and the second time period may be different.

In some embodiments, a laundry washing machine may include a first liquid detergent tray having a first top opening with one or more first recesses. In various embodiments, the laundry washing machine may include a second liquid detergent tray adjacent the first liquid detergent tray, wherein the second liquid detergent tray includes a second top opening. In some embodiments, the laundry washing machine may include at least one sprayer. Moreover, in various embodiments, the one or more first recesses of the first liquid detergent tray may be at a lower elevation than the second top opening of the second liquid detergent tray.

In addition, in various embodiments, the one or more first recesses may include a lower edge below an upper edge. In some embodiments, the second top opening of the second liquid detergent tray may include one or more second recesses. In various embodiments, the one or more second recesses may include a lower edge, wherein the lower edge of the one or more second recesses are position above the lower edge of the one or more second recesses. In some embodiments, each one of the first liquid detergent tray and the second liquid detergent tray may include an outer periphery adjacent to each other and includes the lower edge, respectively. In various embodiments, a lowermost edge of the second top opening may be vertically offset and laterally offset from a lower edge of the one or more first recesses. In some embodiments, the one or more first recesses may be positioned in at least an adjacent sidewall of the adjacent first liquid detergent tray and the second liquid detergent tray. Moreover, in various embodiments, fluid overflows from the first liquid detergent tray at the lower elevation below the second top opening of the second liquid detergent tray.

In some embodiments, a liquid detergent dispenser having an overflow offset between adjacent liquid detergent trays includes a first liquid detergent tray having one or more overflow structures. In various embodiments, the liquid detergent dispenser includes a second liquid detergent tray adjacent the first liquid detergent tray, wherein the second liquid detergent tray includes one or more overflow structures. In some embodiments, the liquid detergent dispenser includes at least one sprayer. In various embodiments, the one or more overflow structures of the first liquid detergent tray may be vertically offset below the one or more overflow structures of the second liquid detergent tray to minimize overflow fluid from the first liquid detergent tray into the adjacent second liquid detergent tray.

In addition, in some embodiments, the one or more overflow structures of the first liquid detergent tray may be a lower edge of a recess. In various embodiments, the one or more overflow structures of the second liquid detergent tray may be a lower edge of a recess. In some embodiments, the one or more overflow structures of the first liquid detergent tray may be at a lower elevation than a lowermost overflow structure of the one or more overflow structures of the second liquid detergent tray. Moreover, in various embodiments, the one or more overflow structures may be positioned on adjacent outer peripheries of the first liquid detergent tray and the second liquid detergent tray, respectively. In some embodiments, the liquid detergent dispenser may include a laundry washing machine. In various embodiments, the first liquid detergent tray and the second liquid detergent tray may be removably received within a solid detergent tray. In various embodiments, the first liquid detergent tray may include a first siphon and the second liquid detergent tray may include a second siphon.

In some embodiments, a method of introducing liquid detergent into a wash tub of a laundry washing machine at different time periods comprising the steps of providing a first liquid detergent tray and a second liquid detergent tray adjacent to the first liquid detergent tray, wherein each of the first liquid detergent tray and the second liquid detergent tray have at least a portion of an outer periphery adjacent to each other. In various embodiments, the method may include introducing a first fluid into a first liquid detergent tray. In some embodiments, the method may include overflowing a first detergent and the first fluid from the first liquid detergent tray at an elevation below a rim opening of the second liquid detergent tray outer periphery.

In addition, in some embodiments, at least a portion of the overflowing occurs at the portion of the outer periphery adjacent to each of the first liquid detergent tray and the second liquid detergent tray. In various embodiments, at least a portion of the overflowing occurs at one or more recesses within the outer periphery of the first liquid detergent tray. In some embodiments, the method may include the step of overflowing a second detergent and a second fluid from the second liquid detergent tray at a time period different from the step of overflowing from the first liquid detergent tray.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
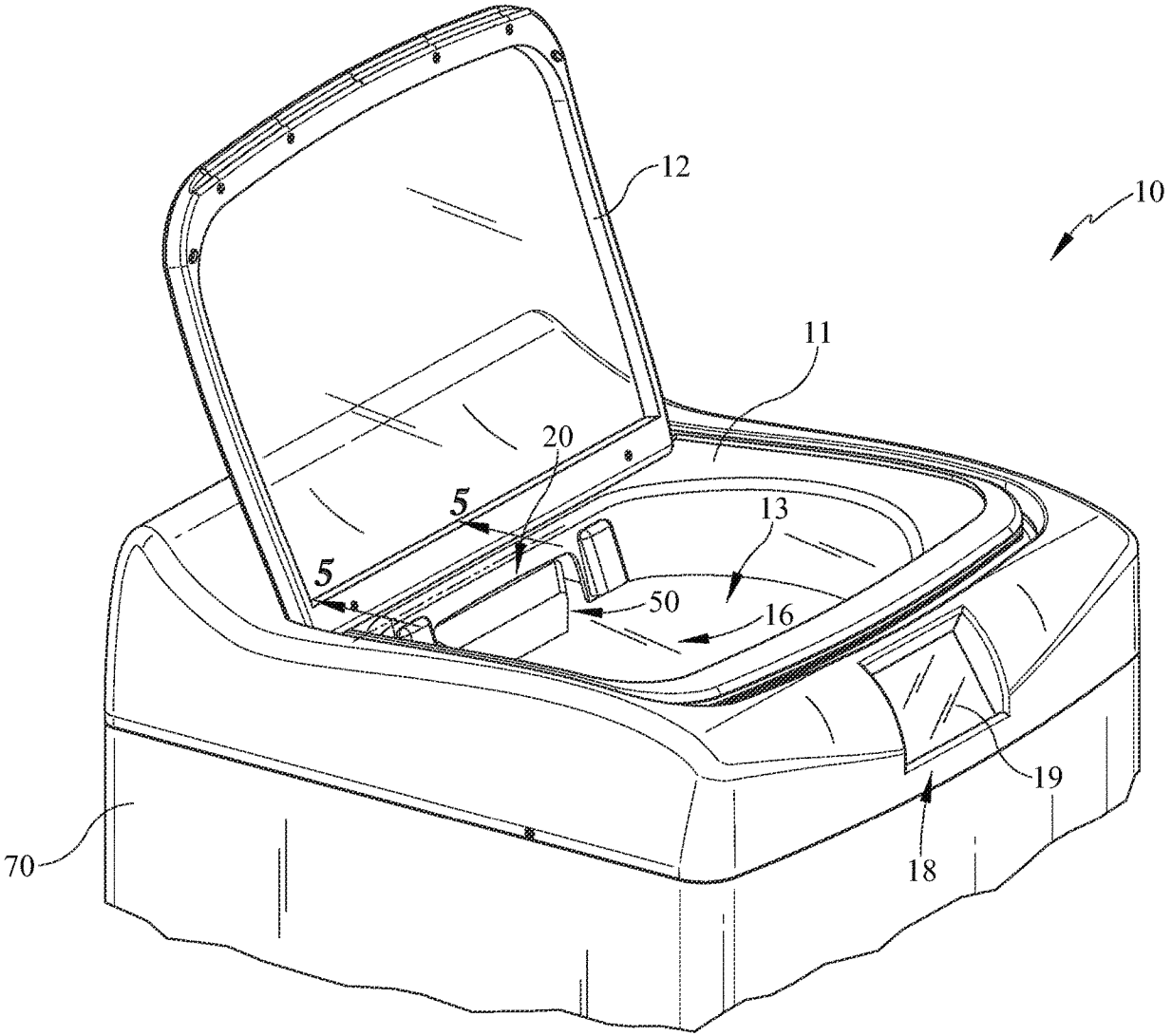
FIG. 1 is a perspective view of an embodiment of a dispenser in a laundry washing machine, with portions of the laundry washing machine broken away.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. For example, a front-load laundry washing machine that includes a front-mounted door in a cabinet or housing that provides access to a horizontally-oriented wash tub housed within the cabinet or housing may be used. Implementation of the herein-described techniques within a front-load laundry washing machine would be well within the abilities of one of ordinary skill in the art having the benefit of the instant disclosure, so the invention is not limited to the top-load implementation discussed further herein.

Turning now to the drawings, wherein like numbers denote like parts throughout the several views, FIGS. 1-5 illustrate an example laundry washing machine 10 in which the various technologies and techniques described herein may be implemented. Laundry washing machine 10 is a top-load washing machine, and as such includes a top panel or cover 11 having a top-mounted door 12 defining an opening or tub aperture 13 towards a cabinet or housing 70 that provides/defines access to a vertically oriented or mounted wash tub 16 housed within the cabinet or housing 70. Door 12 is generally hinged along a side or rear edge and is pivotable between the opened position illustrated in FIG. 1 and a closed position (not shown). When door 12 is in the opened position, clothes and other washable items may be inserted into and removed from wash tub 16 through the tub aperture 13 in the top panel 11 of cabinet or housing 70. Control over washing machine 10 by a user is generally managed through one or more control panels 18 and implementing a user interface 19, and it will be appreciated that in different washing machine designs, control panel 18 may include various types of input and/or output devices, including various knobs, buttons, lights, switches, textual and/or graphical displays, touch screens, etc. through which a user may configure one or more settings of the laundry washing machine.

Figure 2:
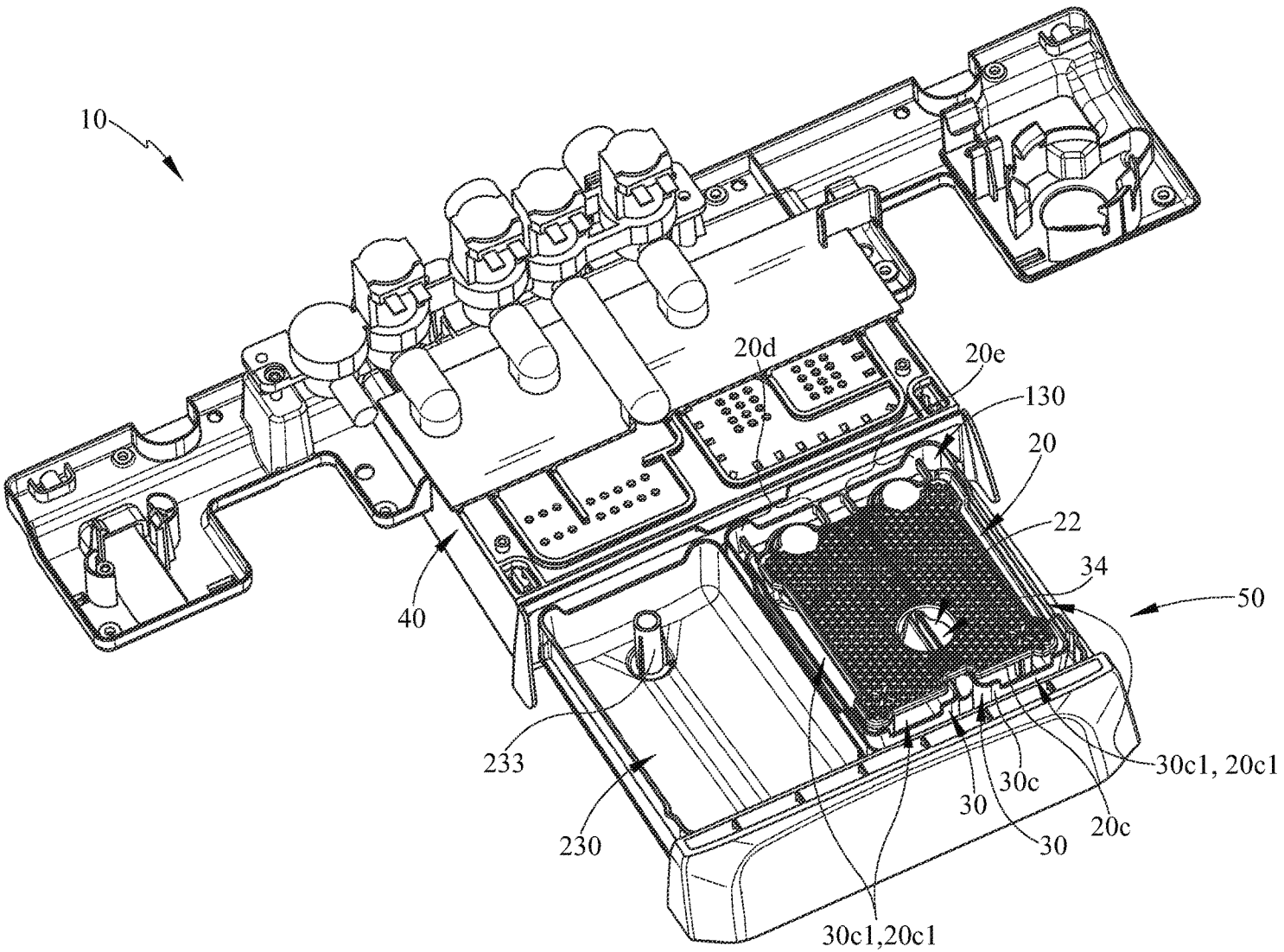
FIG. 2 is a perspective view of the dispenser of FIG. 1 with the dispenser deployed from a stowed positon in communication with the sprayers.
Figure 3:
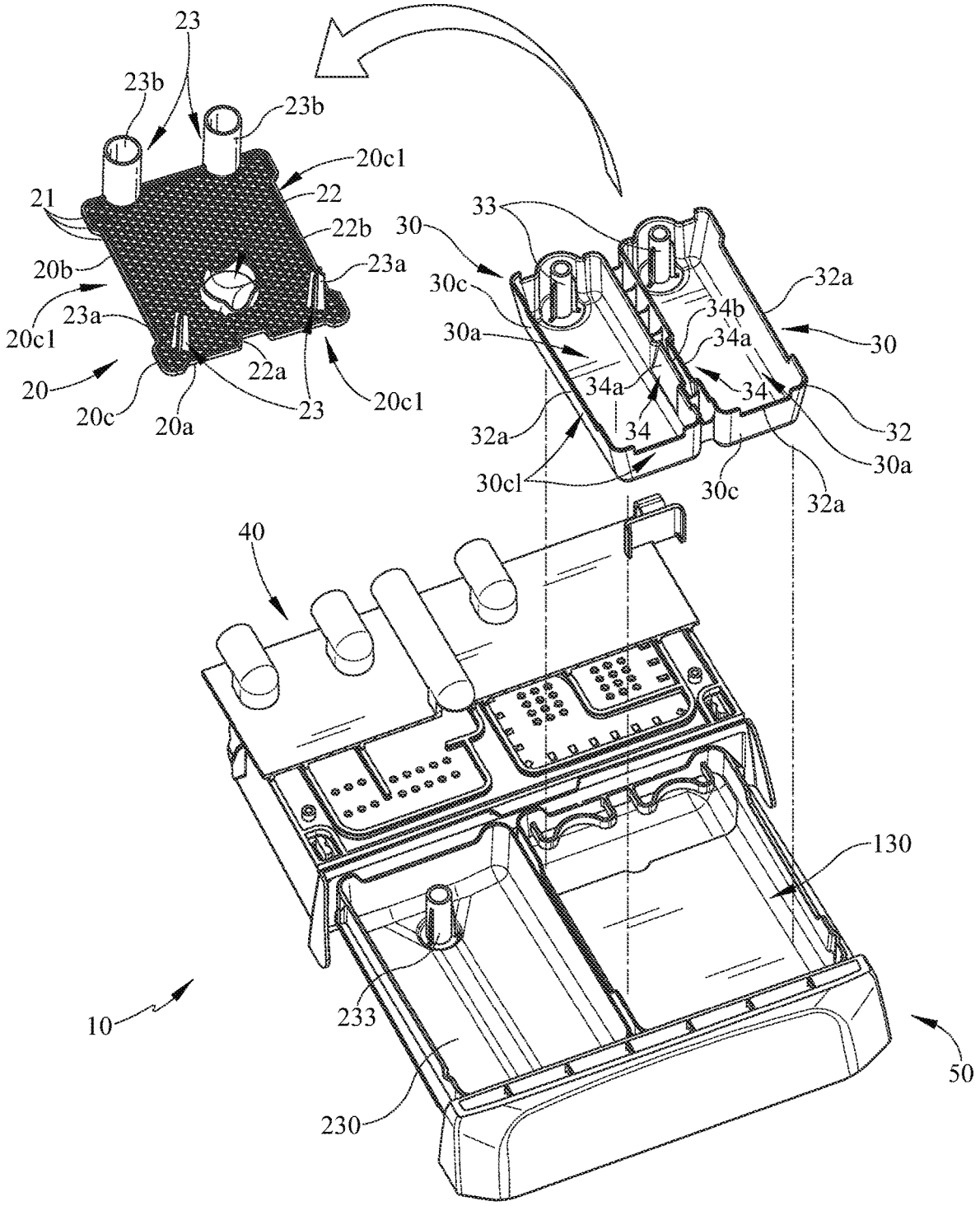
FIG. 3 is an exploded view of the liquid detergent trays and screen of FIG. 2 from the deployed dispenser.

In some implementations, the one or more dispensers 50 may include the laundry washing machine 10. The one or more dispensers 50 may be a variety of sizes, shapes, quantities, constructions, and positions within the machine 10. For example, in the one embodiment shown in the Figures, the dispenser 50 is a drawer positioned between a stowed position (FIGS. 1 and 5) and a deployed position (FIGS. 2 and 3).

As shown in the Figures, one or more dispensers 50 may include one or more screens 20 being used to minimize undesirable splashing and/or spraying (e.g. fluid, substances, cleaning compounds, laundry fluids, etc.). The one or more screens 20, or portions thereof, may minimize or block splashing between two or more storage receptacles/compartments/trays 30 adjacent to each other or away from one tray 30. The one or more screens 20 may be a single structure as shown in the one embodiment. Alternatively, the screen 20 may be made of a plurality of components. The screen 20 may include a plurality of through openings 21 therethrough. The through openings 21 may extend from a top surface/wall 20*a* to a bottom surface/wall 20*b* of the screen 20. One or more of the through openings 21 may include an outer periphery 21*a*. The outer periphery 21*a* of one or more through openings 21 may be a hexagonal in shape as shown in the one embodiment. The screen 20 (e.g. outer periphery 21*a*, pour through opening, through openings 21, etc.) may be a variety of shapes, sizes, quantities, and constructions and still be within the scope of the invention. The outer periphery or one or more surfaces 21*a* defining the through openings 21 may be orientated substantially vertical between the top surface 20*a* and the bottom surface 20*b* of the screen. Alternatively, the orientation of one or more through openings 21 may be orientated at angles other than vertical (e.g. angled, tapered up and/or down, etc.). Although the top and bottom surfaces 20*a*, 20*b* are substantially planar and/or parallel to each other in the one embodiment shown, the top/bottom surfaces may be curved, nonparallel, nonplanar, etc. and still be within the scope of the invention.

In some implementations, the one or more screens 20 may include one or more pour through openings 22. The pour through opening 22 may receive the substances/fluids (e.g. cleaning detergent) to pass through to the one or more compartments 31 of the one or more trays 30. The pour through opening 22 may be surrounded by the plurality of through openings 21 of the screen 20 and/or spaced from an outer periphery 20*c* of the one or more screens 20. In the one embodiment shown, the pour through opening 22 may be defined by an outer periphery or a depending skirt 22*a* extending from the top wall 20*a* to an elevation below the bottom wall 20*b* of the screen 20 and/or top edge of the deflection structure 34, if used. The depending skirt 22*a* may also have one or more notches 22*b* to receive one or more walls or outer peripheries of the trays 30 below the screen. The outer periphery or skirt 22*a* may be disposed over one or more trays 30 to direct the detergent or substances to the respective one or more trays/compartments. In the one embodiment shown, the pour through opening 22 (e.g. skirt 22*a*) directs liquid detergent to two adjacent trays 30 such that the liquid detergent may be divided or portioned into amounts (e.g. similar) in their respective trays. The pour through opening 22, if used, may be different than the one or more through openings 21 of the screen 20. For example, the size, shape, quantity, positions, and construction of the openings 21, 22 may be different. Although, in some embodiments the construction, size, shape, quantity, etc. of the openings may be similar.

In some embodiments, the screen 20 may include the outer periphery 20*c* extending between the top wall 20*a* and the bottom wall 20*b*. One or more screens 20 may be disposed over one or more detergent trays 30 (e.g. top openings 30*a* of the trays). For example, as shown in the one embodiment, the screen 20 is disposed over two adjacent trays 30 or openings 30*a* underneath or in downstream communication with one or more sprayers 40 or portions thereof. A first portion 20*d* of the screen 20 may be disposed over a first liquid detergent tray 30 and a second portion 20*e* of the screen 20 may be disposed over an adjacent second liquid detergent tray 30 as shown in the one embodiment. Alternatively, one or more screens 20 may be disposed above one tray 30 or opening 30*a* of one or more trays 30. The outer periphery 20*c* of the screen 20 may be a variety of shapes, sizes, quantities, and construction. As shown in the one embodiment, the outer periphery 20*c* of the screen 20 may be adjacent to or outline a portion of two adjacent tray's outer peripheries 30*c*, respectively, with the screen body extending over another portion of adjacent outer peripheries 30*c* of the trays. In the one embodiment shown, the outer periphery 20*c* of the screen 20 may include one or more notches or recesses 20*c*1. The recesses 20*c*1 of the screen 20 may be spaced away from (e.g. laterally inward) the outer peripheries 30*c* (e.g. recesses/notches 30*c*1) of one or more trays 30. These recesses 20*c*1 may not be included, as shown in the one embodiment, adjacent the outer periphery 30*c* or portions of the trays 30 adjacent to each other (e.g. adjacent the two portions 20*d*, 20*e* of the screen).

In some implementations, the dispenser 50 may include one or more siphons. As shown in the one embodiment, the screen 20 and/or tray 30 may include one or more siphons 33 and/or legs 23. The one or more siphons 33 may used to control the liquid entering the tub 16 at one or more times from the one or more trays 30. The siphons 33 and/or legs 23 may position the screen 20 (e.g. bottom and/or top wall) at an elevation relative to the one or more trays 30 or tray openings 30*a*. The siphon 33 may be positioned with one or more portions 20*d*, 20*e* of the screen 20 and depend upwardly from the one or more trays (e.g. positioned in adjacent trays). As shown in the one embodiment, one siphon 33 may be positioned in one tray 30 and another siphon 33 may be positioned in the adjacent tray 30. The one or more screens 20 may be attached to the one or more trays in a variety of ways (e.g. mechanically, adhesively, molded together or separately, etc.). For example, the screens may secured to the walls of the tray or one or more peripheries of the one or more trays. Moreover, the screen 20 may be removeably attached, as shown in the one embodiment, or fixed to the one or more trays 30. The screen 20 may include a variety of legs 23 to engage the one or more trays or portions thereof. For example, as shown in the one embodiment, one or more first legs 23*a* adjacent one end of the screen and one or more second legs 23*b* depending from an opposing end of the screen. The first leg 23*a*, if used, may be a post depending to the bottom of the tray. The second leg 23*b*, if used, may be a cylinder/sleeve depending from the screen 20 and/or surrounding at least a portion of the siphon 33.

The two or more compartments 31 may be defined by two or more trays or cups 30 to dispense one or more substances (e.g. liquid detergent) into the wash tub 16. In the one embodiment shown, two trays 30 or compartments 31 are adjacent to each other. One or more of the adjacent trays 30 may be fixed and/or removable from the laundry washing machine or portions thereof. Two trays 30 may be connected or combined as shown in the one embodiment. For example, the two adjacent trays 30 may be connected with each other and may be removable together from the laundry washing machine or portions thereof (e.g. powder/solid detergent tray, drawer, etc.). The two trays 30 may be removable from or received by tray 130. The screen 20, as shown in FIG. 3 of the one embodiment, is removable with the two trays 30. Alternatively, the trays 30 may be individual components. The one or more trays 30 may be a variety of sizes, shapes, quantities, constructions, and positions relative to each other and still be able to receive/dispense.

In the one embodiment shown, the one or more trays 30 may include one or more outer peripheries 30*c*. One or more trays 30 may include one or more portions of an outer periphery adjacent to another outer periphery of one or more trays 30. The one or more trays 30 or outer peripheries 30*c* may also include one or more notches, openings, or recesses 30*c*1. In the one embodiment shown, one or more notches/recess 30*c*1 may be within or adjacent an upper edge 32 of the tray 30. The notches 30*c*1 may create one or more lower steps or edges 32*a* at a lower elevation than a remaining portion of the upper edge 32 creating an overflow path over the upper edge of the tray towards the receiving tray 130 (e.g. solid detergent tray) and/or wash tub 16. The adjacent notches/recesses 20*c*1 and/or 30*c*1, if used, of the screen 20 and/or the tray 30, adjacent the outer peripheries, may create a flow path larger (e.g. different, increased through volume, wider, increased cross-section, etc.) than the remaining adjacent portions (e.g. outer peripheries) between the one or more trays and screens. This larger or wider flow path may decrease undesired overflow or imped flow at undesirable locations (e.g. places other than the notches 30*c*1, steps 32*a*, notches 20*c*1, etc.) about the upper edge 32 of the one or more trays when sprayed/filled by the sprayers 40. The outer periphery 30*c*, upper edge 32, or steps 32*a* of the one or more trays 30 may be lower in elevation than the adjacent outer peripheries or edges of the adjacent trays (e.g. adjacent the pour through opening 22 or adjacent portions 20*d*, 20*e*) to reduce cross over of fluid between trays.

Figure 4:
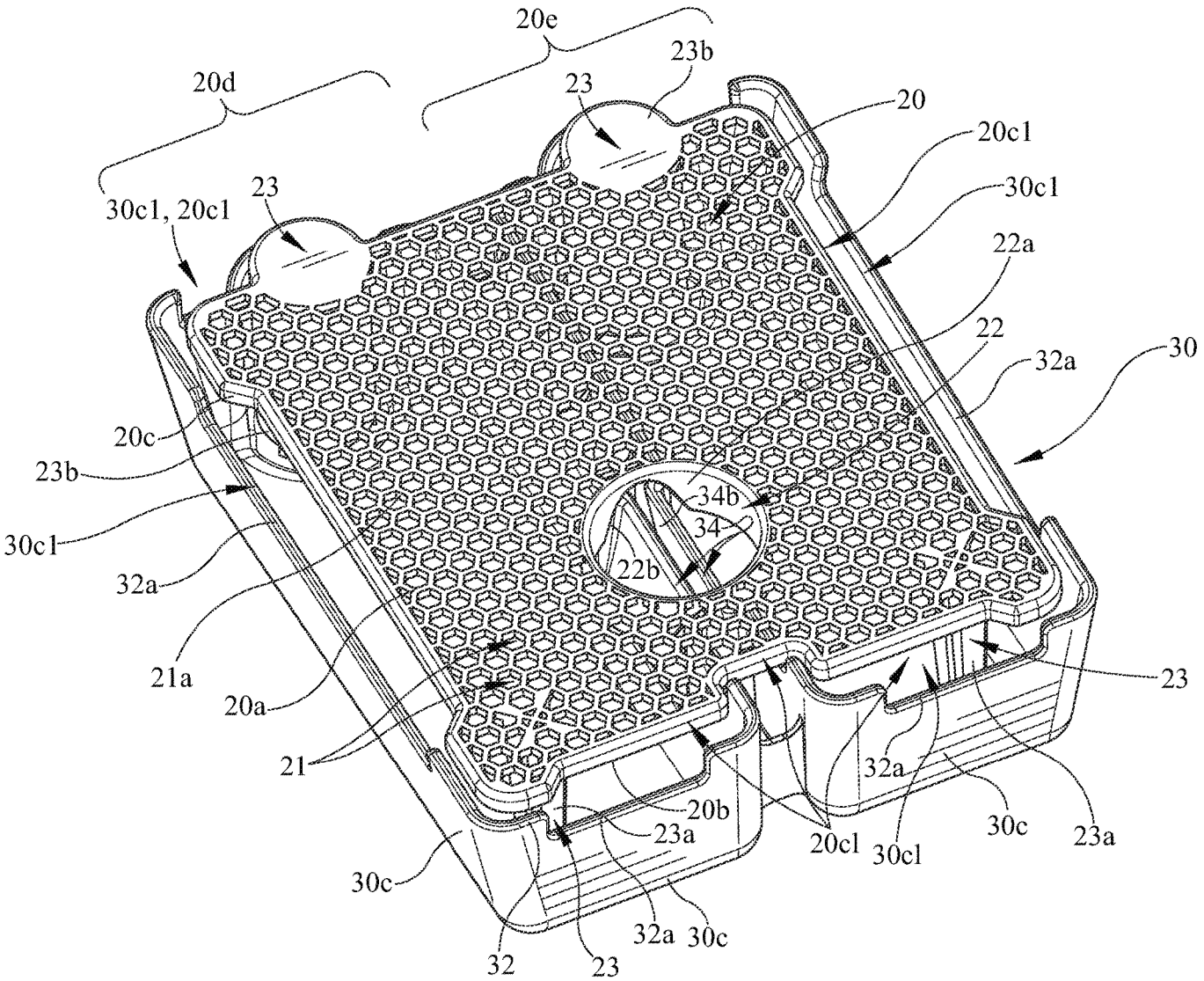
FIG. 4 is a perspective view of the assembled screen and liquid detergent trays of FIG. 2.
Figure 5:
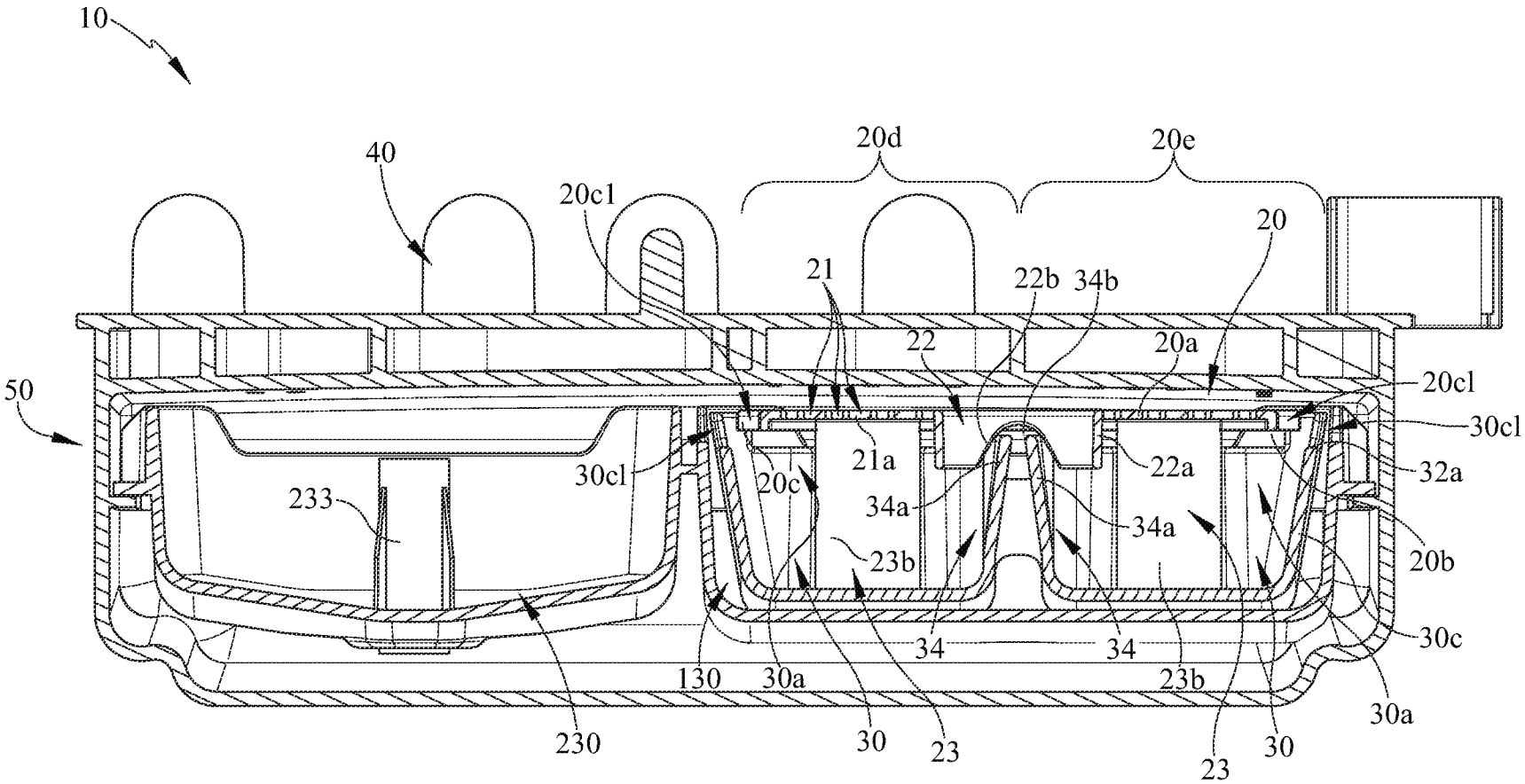
FIG. 5 is a sectional view of dispenser in the stowed position taken along line 5-5 of FIG. 1.

In some implementations, the dispenser 50 may include one or more trays 30 having one or more deflection structures or members 34. The one or more deflection structures 30 may deflect liquid detergent towards one or more of the trays (e.g. first liquid detergent tray and/or the second liquid detergent tray). The one or more deflection structures 34 may be positioned adjacent portions or upper edges 32 of the adjacent trays 30 (e.g. adjacent outer periphery portions of the adjacent trays, pour through opening 22, etc.). The one or more pour through openings 22 of the screen 20 may be disposed over or be adjacent the one or more deflection structures 34 of the one or more trays 30. The one or more notches 22*b* (e.g. an inverted u-shape) of the pour through opening skirt 22*a* (e.g. depending cylindrical member) may surround or engage at least a portion of the deflection structure or extend to an elevation or height below the upper edge 32 of the outer periphery or wall of the tray. The deflection structure 34, as shown in FIGS. 4 and 5, may be angled walls 34*a* of the tray (e.g. adjacent portions of adjacent trays/outer peripheries). The angled walls 34*a* of the adjacent trays form a triangular shape with an upper apex 34*b* received within the notch 22*b* of the pour through opening skirt 22*a*. The angled walls 34*a* flare downwardly and outwardly towards the interior of the tray 30 or compartment 31, respectively. Correspondingly, the notch 22*b* of the skirt 22*a* may narrow in a direction from the bottom wall 20*b* towards the top wall 20*a* of the screen 20 or skirt 22*a*.

In some embodiments, the one or more dispensers 50 may include one or more sprayers or fluid dispensers 40 in fluid communication with the one or more trays/screens. The one or more sprayers 40 may be positioned above the one or more portions (e.g. 20*d*, 20*e*) of the screen 20 (e.g. when in the stowed position). As shown in FIGS. 1 and 5, the screen 20 or portions thereof may be disposed between the one or more sprayers 40 and the one or more trays 30. The one or more sprayers or upstream fluid dispensers 40 may spray or rinse the substances or portions thereof (e.g. liquid detergent) from the one or more trays 30 by passing through the screen or portions thereof. The screen 20 or portions thereof allows the spray water or fluid from the sprayer 40 to pass through one or more portions of the through openings 21 or screen 20 and into one or more compartments 31 (e.g. at one or more times, locations, and/or durations) defined by the trays thereby blocking lateral spray and/or minimizing splashing into the adjacent trays. The one or more sprayers 40 may release or spray fluid at one or more different time periods through one or more screens or portions thereof and/or trays without screens. For example, one sprayer or portion thereof above a first screen or first portion of the screen may communicate fluid or flow through the first portion of the screen into the first detergent liquid tray for a first time period. Another or the same sprayer, positioned above a second screen or second portion of screen, may communicate fluid or fluid flow through the second portion of the screen into the second detergent liquid tray at another or second time period. The one or more screen portions and/or through openings 21 of the one or more screens correspondingly minimize or substantially block fluid, flow, or splashing into the adjacent liquid detergent tray not being used in their respective screen portion or time period. The one or more sprayers 40 may be of a variety of constructions, quantities, shapes, and sizes and still communicate fluid with one or more screens or portion thereof. For example, the sprayers may be in fluid communication with the one or more screens when the screens, trays, or dispenser are at least positioned in a stowed positon with the laundry washing machine and/or sprayers.

In use, the one or more screens 20, or portions thereof (e.g. through openings 21, etc.), reduces the fluid splashing or transferring from one tray with a screen to at least one another tray (e.g. another tray with or without a screen). The fluid can pass through the screen, and impedes splashing towards (e.g. upwardly and/or sideways) an adjacent tray or other portion of the laundry washing machine. In some implementations, the user may deploy the dispenser 50 of the machine 10 and expose the one or more screens 20 and/or trays 30. The user may pour the liquid detergent into the pour through opening 22 of the one or more screens 20. The liquid detergent may come in contact with the one or more deflection structures 34 and disperse substantially equal amounts of liquid detergent to the first liquid detergent tray 30 and the adjacent second liquid detergent tray 30. The dispenser 50/screen 20/tray 30 may be returned to the stowed position and/or into fluid communication with the one or more sprayers 40 or water/fluid of the laundry washing machine 10. During one or more cycles (e.g. pre-wash, wash, etc.), the liquid detergent in one or more of the trays 30 may be siphoned out to the wash tub 16. For example, if the first liquid detergent tray 30 is siphoned out to the wash tub 16, one or more sprayers 40 may rinse the first liquid detergent tray by passing fluid through the first portion 20*d* of the one or more screens 20 for a first time period. The rinse water and liquid detergent may be siphoned and/or flow over the walls of the first tray (e.g. tray/screen notches, if used) into the lower solid detergent tray 130, if used. For example, the rinse water and liquid detergent may flow adjacent the notches/recesses of the screen and/or tray. Therefore the wash tub may utilize the liquid detergent from the first tray to utilize, activate, clean with a portion of the enzymes of the detergent, instead of using all the liquid detergent or enzymes at one time. As such, the screen portion 20*d* reduces splashing (e.g. anti-splashing) of fluid (e.g. rinse water) to reduce contamination or premature release of enzymes from the adjacent liquid detergent maintained within the adjacent second liquid detergent tray. Subsequently at another or second time period, the second liquid detergent tray may be siphoned out to the wash tub, one or more sprayers 40 may rinse the second liquid detergent tray 30 by passing fluid through the second portion 20*e*, if used, of the one or more screens 20 for the second time period. The rinse water and liquid detergent may be siphoned and/or flow over the walls of the second tray (e.g. tray/screen notches, if used) into the lower solid detergent tray 130, if used. Therefore the wash tub can utilize the liquid detergent from the second tray to utilize, activate, clean with the second portion of the enzymes of the detergent. Advantageously, this may increase the cleaning properties and efficiency of the laundry washing machine. In some embodiments, implementations, and/or wash cycles, the screen with/or without one or more trays may be removed from the laundry washing machine or solid detergent tray, so that powder detergent may be used in the solid detergent tray. Moreover, the screen 20 or portions thereof may reduce splashing towards another/adjacent tray such as for example tray 230, without a screen in the one embodiment shown, within the dispenser 50 that may use another detergent fluid (e.g. softener). During one or more cycles and/or another or time period, the detergent tray 230 may be siphoned out to the wash tub and one or more sprayers 40 may rinse the detergent tray 230. The rinse water and liquid detergent (e.g. softener) may be siphoned into the wash tub 16 from tray 230, if used.

In some implementations, the introduction of liquid detergent into a wash tub of a laundry washing machine may occur at one or more time periods. In some embodiments, these time periods may be different when introducing detergent into the wash tub. The rinse water or first fluid may be sprayed through one or more screens (e.g. a first portion of a screen) and into a first liquid detergent tray. One or more second liquid detergent trays, if used, may be adjacent the first liquid detergent tray. The one or more screens disposed above the first liquid detergent tray may block or minimize lateral spray of the first fluid in the second liquid detergent tray. In some embodiments, the second liquid detergent tray may include one or more screens (e.g. a second portion of a screen). The rinse water or second fluid may be sprayed into the second liquid tray and/or through the second portion of the one or more screens. If used, the screen may block or minimize the lateral spray of the second fluid into the first liquid detergent tray. Blocking lateral spray of the first/second fluid may include blocking spray of the first/second fluid that has already passed downwardly through the first/second portion of the one or more screens. The method may include adding liquid detergent through the one or more screens to both the first liquid detergent tray and the second liquid detergent tray together at the same time period. In some embodiments, liquid detergent may be deflected towards each one of the first liquid detergent tray and the second liquid detergent tray. In various embodiments, the first liquid detergent tray, the adjacent second liquid detergent tray, and the one or more screens may be removed together or separately from the laundry washing machine. For example, cleaning or use of another or different tray/cycle. When blocking lateral spray of the fluid, the screen or portions thereof may block spray of the fluid that has already passed downwardly through the one or more screens and/or reduce lateral spray exiting from the sprayer. In addition, in various embodiments, spraying the first liquid may include dispensing a first liquid detergent from the first liquid detergent tray at a first time period and the step of spraying the second liquid may include dispensing a second liquid detergent from the second liquid detergent tray at a second time period. In various embodiments, the first time period and the second time period may be different. Moreover, in some embodiments, the first and second liquid detergent may be the same detergent. Alternatively, the first and second liquid detergent may be different.

Figure 6:
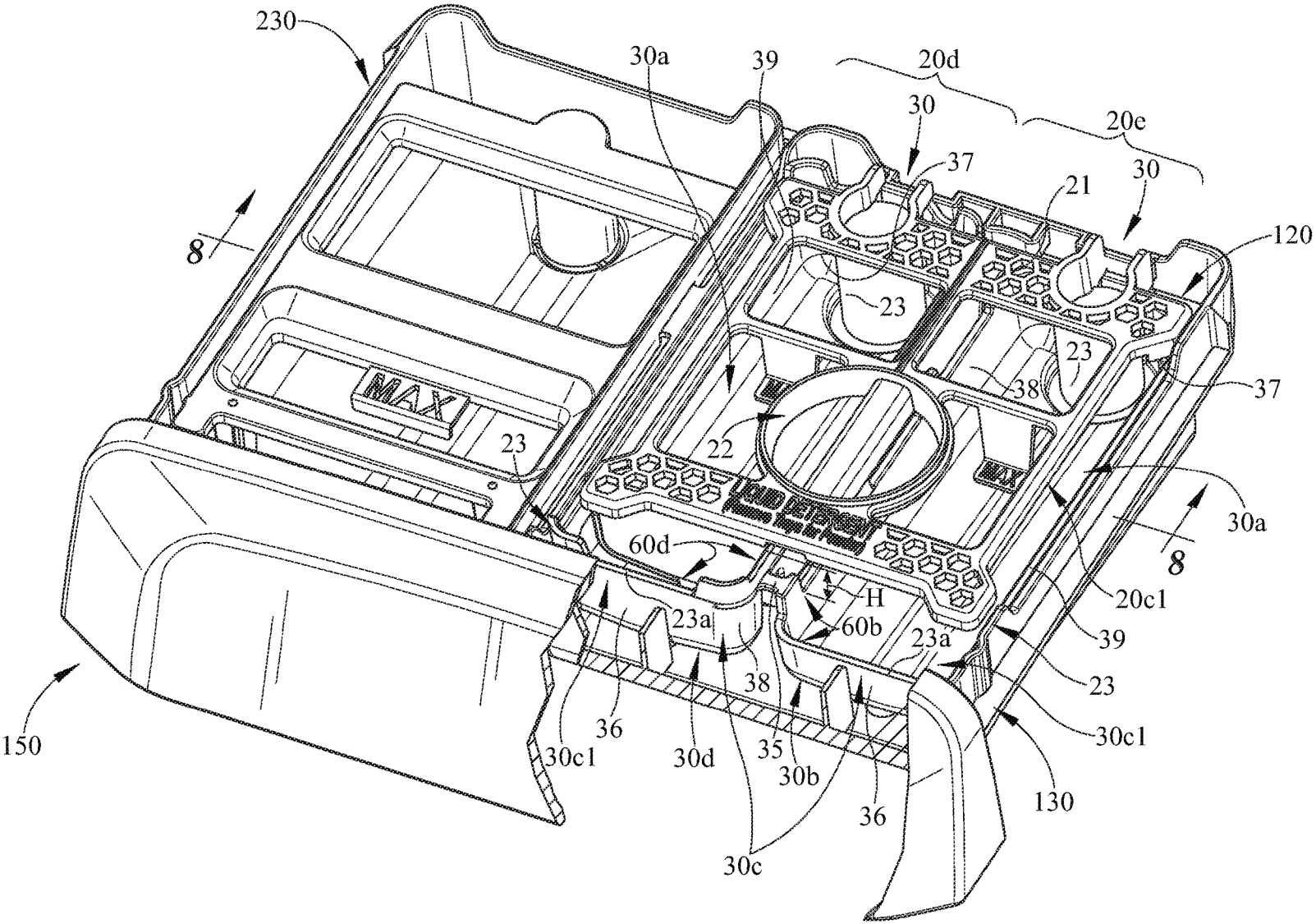
FIG. 6 is a perspective view of another embodiment of a dispenser with an assembled screen and liquid detergent trays.
Figure 7:
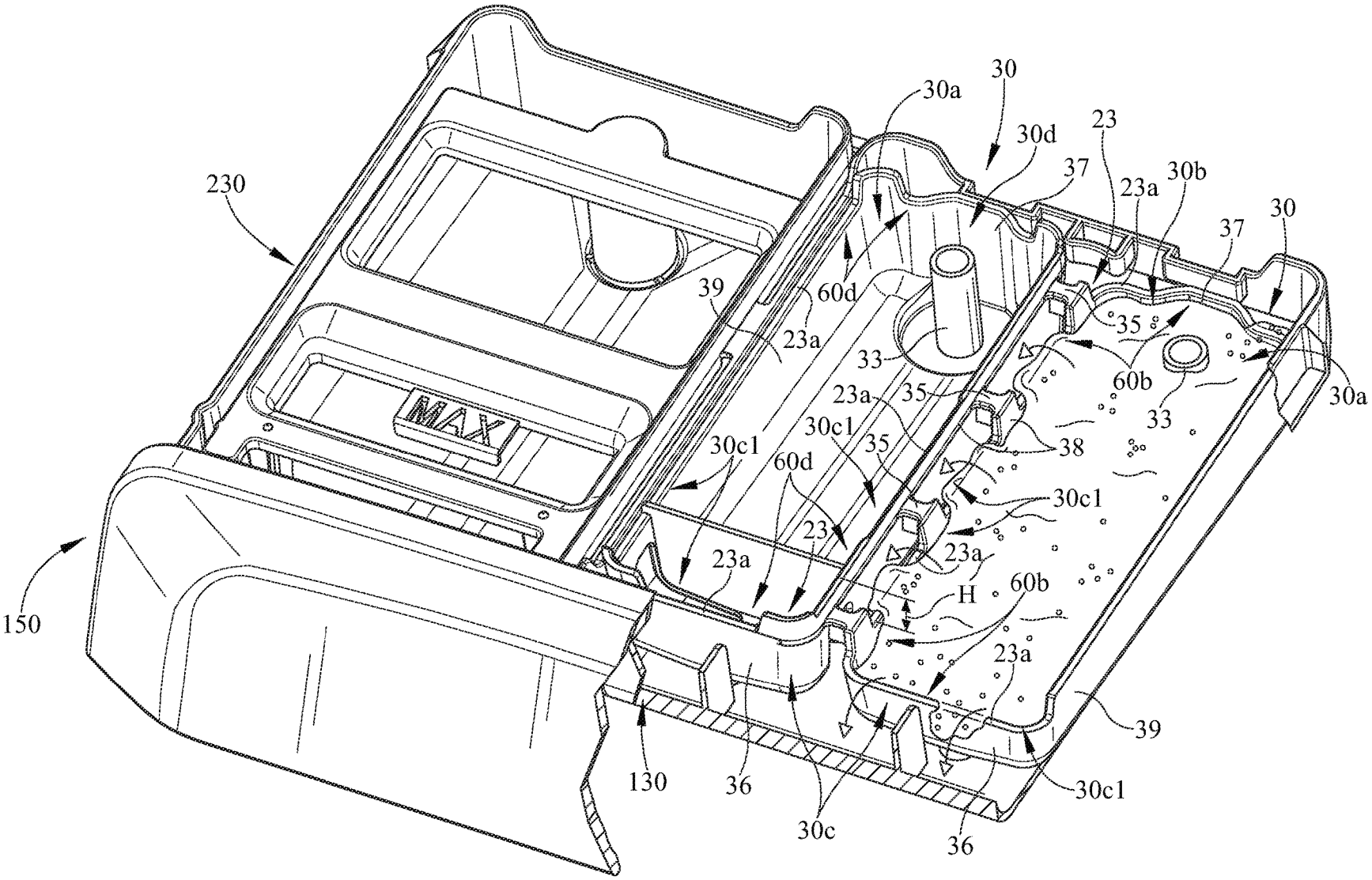
FIG. 7 is a perspective view of the dispenser of FIG. 6, with the screen removed, illustrating the overflowing of one of the liquid detergent trays.
Figure 8:
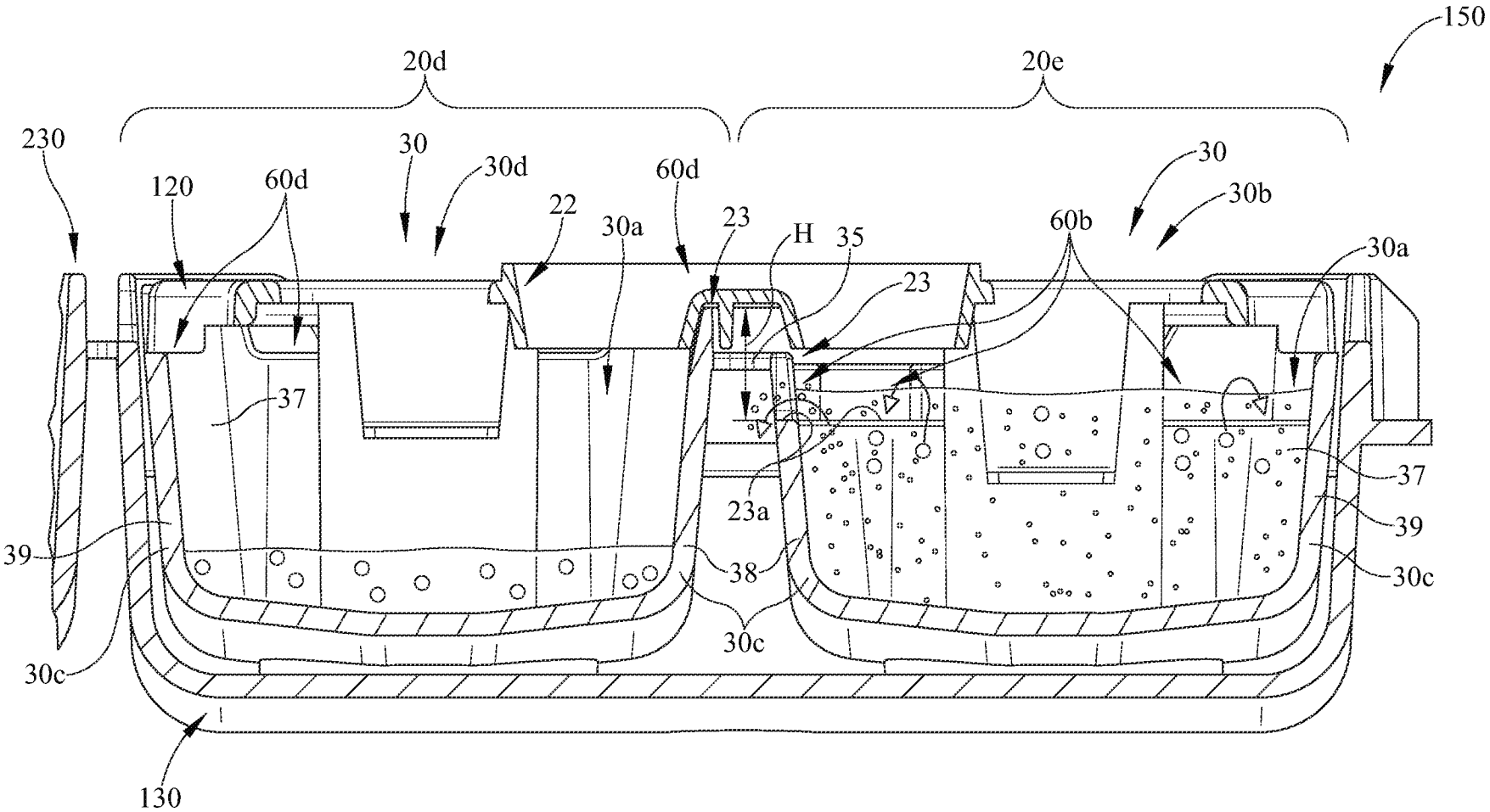
FIG. 8 is a sectional view of the dispenser taken along line 8-8 of FIG. 6 illustrating the overflowing of one of the liquid detergent trays.

In some implementations, as shown in the one embodiment of dispenser 150, one or more adjacent trays 30 overflow at a different elevation relative to each other. The vertical offset H of at least one tray 30 (e.g. first liquid detergent tray 30*b*) overflow/structure 60*b* (e.g. edge, upper edge 32, weir, lateral opening, lower edge 32*a*, recess 30*c*1, and/or top opening 30*a*, etc.) from an adjacent tray 30 (e.g. second liquid detergent tray 30*d*) overflow/structure 60*d* (e.g. periphery edge, upper edge 32, lateral opening, lower edge 32*a*, recess 30*c*1, and/or top opening 30*a*, etc.) may minimize or reduce the overflow fluid/spray (e.g. liquid detergent, rinse water, and/or fluid) from migrating to the adjacent liquid detergent tray (e.g. second liquid detergent tray 30*d*). At least one of the adjacent trays 30 may include an overflow or overflow pathway/structure 60*b* at one or more lower elevations than the adjacent tray or trays 30, or portions thereof. The fluid and/or detergent may overflow at the lower elevation or vertical offset H below of the adjacent tray or structure (e.g. the top opening 30*a*, recess 30*c*1, overflow 60*c*, lower edge 32*a*, upper edge 32, outer periphery 30*c*, etc.) into the wash tub 16 and/or solid detergent tray 130. The overflow structure 60*b*, 60*d* of the one or more trays 30 may be a variety of shapes, sizes, quantities, construction, and positons without the one or more trays. For example, the overflow structure may be positioned discontinuously spaced or continuously about the outer periphery, upper edge, top opening, or sidewall of the tray, or portions thereof, (e.g. adjacent outer periphery or sidewall 38 of the adjacent tray, rear sidewall 37, front sidewall 36, and/or sidewall 39 or outer periphery away from the adjacent tray). Some sidewalls of either tray 30 may not include overflow structure 60*b*, 60*d*, such as but is not limited to the recess 30*c*1, in some embodiments. Moreover, in some embodiments, the overflow structure of one tray may have different overflow structure at one or more elevations and/or positions (e.g. about the rim opening, periphery, etc.). As shown in FIGS. 6-8, if a recess 30*c*1 or lower edge 32*a* is used, the lower edge 32*a* of the first liquid detergent tray 30*b* sidewall (e.g. 38) is lower than at least one of the lower edge 32*a*, top opening 30*a*, upper edge 32 of one or more of the sidewalls (e.g. 38) of the second liquid detergent tray 30*d* by offset H. In some embodiments, the first liquid detergent tray 30*b* may have a top opening 30*a* having the upper edge 32 with the same elevation along its length and still have the offset H at one or more of the sidewalls, or portions thereof (e.g. adjacent sidewall 38 or a recess, if used).

In some embodiments, the overflow structure of one tray (e.g. first liquid detergent tray 30*b*) is vertically offset H below the structure (e.g. overflow structure 60*d*, sidewall 38, top opening 30*a*, etc.) of the adjacent tray (e.g. second liquid detergent tray 30*d*) to minimize overflow fluid from one tray to the other or adjacent tray. The overflow structure or lower tray structure at the lower elevation overflows the fluid below the rim, top opening 30*a*, edge 32/32*a*, overflow structure 60*d*, etc. of the adjacent or higher tray. The overflow structure 60*b* or tray structure at the lower elevation may be the lowermost edge or pathway (e.g. lower step or edge 32*a*) to overflow fluid first from the tray in some embodiments when the fluid rises therein. Fluid may continue to rise and overflow at another or higher elevation of structure (e.g. upper edge 32) of the tray. In the one embodiment shown in FIGS. 6-8, the overflow structure 60*b* may be one or more overflow edges/structures 32/32*a* of the one or more adjacent trays. The lower edge 32*a* and/or recess 30*c*1 may be the overflow structure or lowermost elevation structure/edge in some implementations of the tray (e.g. first liquid detergent tray 30*b*) to allow fluid to flow over below one or more pathways or structure into the adjacent tray (e.g. second liquid detergent tray 30*d*). In some embodiments, the top opening 30*a* overflow structure/edge 60*b* of the first liquid detergent tray 30*b* may be the lower edge 32*a* of at least one recess 30*c*1. In various embodiments, the overflow structure 60*d* or the lower edge 32*a*, if used, of at least one recess 30*c*1 within the second liquid detergent tray 30*d* may be positioned above the overflow structure (e.g. top opening 30*a*, recess 30*c*1, edge 32/32*a*, etc.) of the first liquid detergent tray. In some implementations, the overflow structure 60*b* of the first liquid detergent tray may be at the lower elevation than the lowermost overflow edge/structure of the one or more overflow structures of the second liquid detergent tray. The lowermost overflow edge/structure of the second liquid detergent tray that may overflow first when the fluid rises may be at one or more sidewalls (e.g. 36-39).

In some implementations, the overflow structure of the first liquid detergent tray 30*b* may be positioned at one or more positions about the top opening 30*a* and/or outer periphery 30*c*. As shown in FIGS. 6-8, the overflow structure 60*b* (e.g. edge, upper edge, lower edge, top opening, etc.) of the first liquid detergent tray may be at least positioned on the adjacent outer periphery or sidewall 38 towards the second liquid detergent tray. The rear sidewall 37, front sidewall 36, sidewall 39, and/or adjacent sidewall 38 next to the second liquid detergent tray may include one or more overflow structures (e.g. lower edge 32*a*, upper edge 32, recess 30*c*1, top opening 30*a*, etc.) as shown in the one embodiment. It is understood a variety of positions of the overflow structure/edge may be used and still be offset H.

The overflow structure 60*b*, recess 30*c*1, upper edge 32, or lower edge 32*a* of the first liquid detergent tray 30*b* may be at a lower elevation than the top opening 30*a*, or portions thereof, of the second liquid detergent tray 30*d*. As shown in the FIGS. 6-9, the lower elevation or offset H is at least in the adjacent sidewalls 38 of the two adjacent trays 30. The top opening 30*a* of the second liquid detergent tray 30*d* may be at the higher elevation or offset H above the top opening 30*a* (e.g. overflow structure 60*b*) of the first liquid detergent tray 30*b*. In some embodiments, the top opening 30*a*, periphery 30*c*, or sidewall 38 of the second liquid detergent tray 30*d*, adjacent to the sidewall 38, periphery 30*c*, or overflow structure 60*b* of the first liquid detergent tray 30*b*, may be positioned vertically (e.g. offset H) above the overflow structure 60*b* or adjacent portions of the first liquid detergent tray. In some embodiments, the overflow structure 60*b* may be positioned on sidewall 36, 37, and/or 39 of the first liquid detergent tray 30*b* not adjacent to the second liquid detergent tray 30*d*. For example, the rear sidewall 37 and/or the front sidewall 36 may only have the overflow structure 60*b* to overflow away from the second liquid detergent tray in some embodiments. In some implementations, the lower edge 32*a*, if used, or upper edge 32 of the second liquid detergent tray 30*d* may be positioned above the top opening 30*a* (e.g. lower edge 32*a* and/or upper edge 32) or recess 30*c*1, if used, of the first liquid detergent tray 30*b*. In the one embodiment shown in FIG. 7, the lower edge 32*a* of the recess 30*c*1 may be positioned on adjacent sidewalls 38 or peripheries 30*c* of the two adjacent trays 30*b*, 30*d*. The lower edge 32*a* or other structure may be the lowermost edge of the top opening 30*a* of the second tray sidewall 38. For example, as shown in the one embodiment, the second liquid detergent tray sidewall 38 adjacent to the first liquid detergent tray 30*b* may have the lowermost edge in some embodiments such that the lowermost edge of the second tray top opening 30*a* is vertically and lateral offset above the first liquid detergent tray. One or more bridges 35, if used, may laterally offset and connect the adjacent trays 30*b*, 30*d*.

As shown in FIG. 7, in some embodiments, one or more bridges 35 may interconnect the two adjacent trays 30. The one or more bridges 35 may be positioned at a higher elevation or vertically offset H above the lower edge 32*a* of the recess 30*c*1 or overflow structure 60*b* of the first liquid detergent tray 30*b*. Each bridge 35 may extend from the upper edge 32 of the first liquid detergent tray 30*b* to the sidewall 38 of the second liquid detergent tray 30*d* or below the upper edge 32 and/or lower edge 32*a* of the second liquid detergent tray 30*d* as shown in FIG. 8 in some embodiments. The overflow fluid may overflow over the lowermost edge or overflow structure 60*b* of the first liquid detergent tray 30*b* or first tray opening 30*a* below the top opening 30*a* or elevation of the sidewall 38 of the second liquid detergent tray 30*d*, or portions thereof adjacent to the first liquid detergent tray. The overflow fluid may pass between adjacent bridges 35 and downwardly between the trays 30. If one or more sidewalls defining the top opening 30*a* each include overflow structure 60*b*, are at the same elevation, or have the lowermost edge, the overflow fluid may overflow at those one or more positons respectively.

In use, in some implementations, each one of the liquid detergent trays (e.g. first liquid detergent tray 30*b* and second liquid detergent tray 30*d*) may include liquid detergent therein. One or more sprayers 40 may be used to introduce the rinse water or a first fluid through a screen 120 or portions thereof, if used, into the top opening 30*a* of the first liquid detergent tray 30*b*. The liquid detergent and first fluid rises in elevation or volume within the tray. As shown in the one embodiment in FIG. 8, the liquid detergent and first fluid overflows from the first liquid detergent tray 30*b* at an elevation or vertical offset H below the top opening 30*a* (e.g. upper edge, lower edge, sidewall, outer periphery) of the second liquid detergent tray 30*d*. The overflow from the first liquid detergent tray may occur at the outer periphery 30*c*, or portions thereof, adjacent to the trays 30. Alternatively, the overflow may occur at one or more locations about the first tray outer periphery 30*c*. The one or more overflow fluids overflowing from the first liquid detergent tray may occur at one or more recesses 30*c*1 (e.g. lower edge 32*a*), if used, or lowermost edge of the top opening 30*a* within the outer periphery of the first liquid detergent tray (e.g. sidewall 38). The first liquid detergent tray 30*b* may also use the siphon 33 to introduce the detergent to the wash tub 16 or lower solid detergent tray 130. Moreover, the one or more sprayers 40 may add a second fluid to the liquid detergent within the second liquid detergent tray 30*d*. The addition of the second fluid may occur at a time period different from the introduction of the first fluid and/or overflowing from the first liquid detergent tray 30*b*. The second liquid detergent tray 30*d* may also use the siphon 33 to introduce the detergent to the wash tub 16 or lower solid detergent tray 130.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A laundry washing machine comprising:

a first liquid detergent tray having a first top opening with one or more first recesses, and a first sidewall defining the first top opening includes the one or more first recesses;

a second liquid detergent tray adjacent the first liquid detergent tray, wherein the second liquid detergent tray includes a second top opening, and a second sidewall defining the second top opening, wherein the second sidewall is immediately adjacent to the first sidewall;

at least one sprayer; and the one or more first recesses of the first sidewall of the first liquid detergent tray is at a lower elevation than the second top opening defined by the second sidewall of the second liquid detergent tray.

2. The laundry washing machine of claim 1 wherein the one or more first recesses includes a lower edge below an upper edge of a remaining portion of the first sidewall defining the first top opening.

3. The laundry washing machine of claim 1 wherein the second sidewall of the second liquid detergent tray includes one or more second recesses.

4. The laundry washing machine of claim 3 wherein the one or more second recesses of the second sidewall includes a lower edge, wherein the lower edge of the one or more second recesses of the second sidewall are positioned above a lower edge of the one or more first recesses of the first sidewall.

5. The laundry washing machine of claim 1 wherein a lowermost edge of the second sidewall defining the second top opening is vertically offset above a lower edge of the one or more first recesses of the first sidewall and laterally offset from the lower edge of the one or more first recesses of the first sidewall.

6. The laundry washing machine of claim 1 wherein fluid overflows from the first liquid detergent tray towards the adjacent second liquid detergent tray at the lower elevation below the second top opening of the second liquid detergent tray without overflowing into the second liquid detergent tray.

7. A liquid detergent dispenser having an overflow offset between adjacent liquid detergent trays comprising:

a first liquid detergent tray including one or more first overflow structures and a first sidewall having the one or more first overflow structures therein;

a second liquid detergent tray adjacent the first liquid detergent tray, wherein the second liquid detergent tray includes one or more second overflow structures and a second sidewall having the one or more second overflow structures, wherein the first sidewall is different from the second sidewall, and wherein the second sidewall of the second liquid detergent tray is adjacent the first sidewall of the first liquid detergent tray;

at least one sprayer; and wherein the one or more first overflow structures of the first sidewall of the first liquid detergent tray is vertically offset below the one or more second overflow structures of the second sidewall of the second liquid detergent tray to minimize overflow fluid from the first liquid detergent tray into the adjacent second liquid detergent tray.

8. The liquid detergent dispenser of claim 7 wherein the one or more first overflow structures of the first liquid detergent tray is a lower edge of a recess.

9. The liquid detergent dispenser of claim 7 wherein the one or more second overflow structures of the second liquid detergent tray is a lower edge of a recess.

10. The liquid detergent dispenser of claim 7 wherein the one or more first overflow structures of the first liquid detergent tray is at a lower elevation than a lowermost overflow structure of the one or more second overflow structures of the second liquid detergent tray.

11. The liquid detergent dispenser of claim 7 further comprising a laundry washing machine.

12. The liquid detergent dispenser of claim 7 wherein the first liquid detergent tray and the second liquid detergent tray is removably received within a solid detergent tray.

13. The liquid detergent dispenser of claim 7 wherein the first liquid detergent tray includes a first siphon and the second liquid detergent tray includes a second siphon.

14. A method of introducing liquid detergent into a wash tub of a laundry washing machine at different time periods comprising the steps of:

providing a first liquid detergent tray and a second liquid detergent tray adjacent to the first liquid detergent tray, wherein each of the first liquid detergent tray and the second liquid detergent tray have at least a portion of an outer periphery immediately adjacent to each other;

introducing a first fluid into a first liquid detergent tray;

overflowing a first detergent and the first fluid from at least the adjacent portion of the outer periphery of the first liquid detergent tray at an elevation below a rim opening of the second liquid detergent tray outer periphery towards at least the adjacent portion of the outer periphery of the second liquid detergent tray without overflowing into the second liquid detergent tray.

15. The method of claim 14 wherein at least a portion of the overflowing occurs at the portion of the outer periphery adjacent to each of the first liquid detergent tray and the second liquid detergent tray.

16. The method of claim 14 wherein at least a portion of the overflowing occurs at one or more recesses within the outer periphery of the first liquid detergent tray.

17. The method of claim 14 further comprising the step of overflowing a second detergent and a second fluid from the second liquid detergent tray at a time period different from the step of overflowing from the first liquid detergent tray.

* * * * *